United States Patent [19]

Arigaya

[11] 4,270,307

[45] Jun. 2, 1981

[54] REMOTE CONTROLLED STEERABLE AMPHIBIOUS TOY

[75] Inventor: Fujio Arigaya, Tanashi, Japan

[73] Assignee: Takara Co., Ltd., Katsushika, Japan

[21] Appl. No.: 85,237

[22] Filed: Oct. 16, 1979

[51] Int. Cl.[3] ..... A63H 30/04; A63H 23/02; A63H 23/04; B63H 5/08

[52] U.S. Cl. ..... 46/254; 46/93; 46/210; 46/206; 46/250; 440/49; 440/71; 440/84

[58] Field of Search ..... 46/254, 262, 210, 219, 46/206, 202, 91, 93, 94, 96, 92, 250, 201; 325/37, 62, 66, 34; 343/225; 115/37, 38, 35, 1 R

[56] References Cited

U.S. PATENT DOCUMENTS

| | | | |
|---|---|---|---|
| D. 162,628 | 3/1951 | Carlin | 46/96 |
| 2,903,822 | 9/1959 | Reid | 46/254 |
| 3,403,654 | 10/1968 | Wilson | 115/1 R |
| 3,600,847 | 8/1971 | Lakin | 46/96 |
| 3,636,910 | 1/1972 | Tsuchiya | 115/37 |
| 3,848,561 | 11/1974 | Price | 115/37 |
| 4,080,602 | 3/1978 | Hattori et al. | 46/219 |
| 4,197,672 | 4/1980 | Mabuchi et al. | 46/254 |

*Primary Examiner*—Gene Mancene
*Assistant Examiner*—Michael J. Foycik, Jr.
*Attorney, Agent, or Firm*—Jackson, Jones & Price

[57] ABSTRACT

A remote controlled self-propelled toy vehicle is disclosed which is capable of moving on a solid support surface and also on water. Two motors and a power source are mounted to the hull of the toy vehicle. Each motor drives, through a suitable transmission assembly, a drive wheel and a screw propeller. The drive wheels are disposed to come into contact with the solid support surface for operation as a land going vehicle, and the screw propellers are disposed for submersion in water when the toy vehicle is operated as a boat.

Steering of the vehicle is accomplished on the solid surface and also on water by varying the power output of the motors so that uneven power output of the two motors causes the vehicle to turn. A suitable, preferably radio signal emitting remote control system and associated circuitry is provided to allow a player to steer the vehicle from a remote location.

12 Claims, 3 Drawing Figures

REMOTE CONTROLLED STEERABLE AMPHIBIOUS TOY

BACKGROUND OF THE INVENTION

1. Field of the Invention

The present invention is directed to an amphibious self-propelling toy, and particularly to an amphibious self-propelling toy which is steered both on a solid support surface and on water by variation of power outputs of motors driving individual wheels and propellers of the vehicle.

2. Brief Description of the Prior Art

The prior art is well aware of amphibious toy vehicles.

The prior art is also aware of remotely controlled toy automobiles and the like wherein two motors are provided and each motor respectively drives a drive wheel or a caterpillar tread of the vehicle. When the two motors provide equal outputs of power, the driven wheels rotate at an even speed and the vehicle advances forward in a straight line. The vehicle is turned by causing the drive wheels to rotate at a different speed relative to one another. U.S. Pat. Nos. 4,080,602, 3,590,526 and West German Patent Application laid open to the public, Ser. No. 28 16 416 describe such prior art toy vehicles.

Signal transmitting and signal receiving systems which enable a player or operator to transmit steering and speed control command signals from a location remote from the vehicle, are described in U.S. Pat. Nos. 4,080,602; 3,372,393, and in the aforementioned West German patent application Ser. No. 28 16 416.

The signal transmitting and signal receiving systems for remote control of a toy vehicle of the prior art have employed several modulation and demodulation techniques for transmitting the information corresponding to the player's or operator's command signals. U.S. Pat. No. 4,080,602 describes e.g. a system wherein a single channel frequency modulated high frequency signal is utilized. U.S. Pat. No. 3,372,393, on theother hand, describes a system wherein a pulse duration modulation method is used. West German patent application laid open to the public Ser. No. 28 16 416 describes a system wherein two pulse signals are transmitted, and the duration of each pulse signal respectively controls the power levels which are applied to the respective electric motors.

Although the prior art has provided several remote controlled toys of the above described nature, there is still a need in the continuously changing toy market for the amphibious remote controlled steerable toy of the present invention.

SUMMARY OF THE INVENTION

It is an object of the present invention to provide a remotely controllable toy vehicle which is capable of advancing on a solid support surface as well as on a water surface.

It is another object of the present invention to provide a remotely controlled amphibious toy vehicle wherein a separate motor energizes each drive wheel or screw propeller of the toy vehicle and wherin steering is accomplished by varying the power output of each motor.

These and other objects and advantages are attained by a toy vehicle which includes a hull or main body chassis having sufficient buoyancy to maintain the vehicle on a water surface. Two motors are incorporated in the hull, and the motors are supplied with power from a suitable power source. Each motor drives a wheel and a screw propeller. The wheels are mounted to the hull for driving the vehicle on a solid support surface when the toy vehicle is operated as a land going vehicle. The screw propellers are mounted to the hull to provide thrust in water when the toy vehicle is operated as a water going vehicle.

A signal transmitting device is provided at a location remote from the toy vehicle to transmit command signals at the option of a player to apply selected levels of power to each motor. The resulting power outputs of the wheels or screw propellers drive the toy vehicle in a straight line or cause a turn depending on the respective relative levels of power outputs of the wheels or screw propellers.

The objects and features of the present invention are set forth in the appended claims. The present invention may be best understood by reference to the following description, taken in connection with the accompanying drawings in which like numerals indicate like parts.

DESCRIPTION OF THE PREFERRED EMBODIMENT

The following specification taken in conjunction with the drawings set forth the preferred embodiment of the present invention in such a manner that any person skilled in the toy manufacturing and electronic arts can use the invention. The embodiments of the invention disclosed herein are the best modes contemplated by the inventor for carrying out his invention in a commercial environment, although it should be understood that various modifications can be accomplished within the parameters of the present invention.

Figure 1:
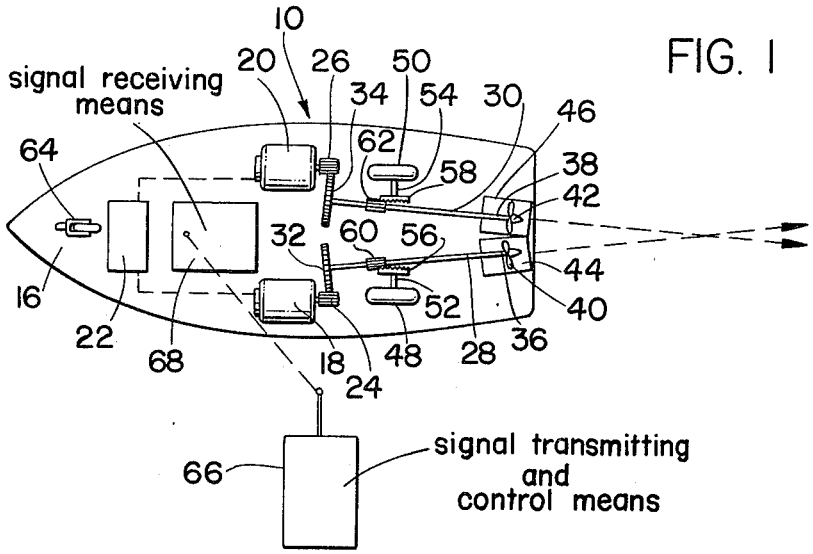
FIG. 1 is a schematic bottom view of a specific embodiment of the amphibious toy vehicle of the present invention.

Referring now to the drawing figures and particularly to the schematic view of FIG. 1, a specific embodiment of the toy vehicle 10 of the present invention is disclosed. The toy vehicle 10, which is particularly designed for travel on a solid support surface 12 (shown on FIG. 2) and also on water 14 (shown on FIG. 3) includes a main body chassis or hull 16. As is shown on the drawing figures, the main body chassis or hull 16 is configured to simulate a motor boat and also a land going vehicle resembling an automobile, particularly an open toy convertible automobile.

The main body chassis or hull 16 is built to be substantially water tight, and contains sufficient air to be buoyantly floating on the surface of water in effective simulation of a real boat.

A first motor 18 and a second motor 20 is mounted into the main body chassis or hull 16 in such a manner that the motors 18 and 20 are not exposed to water 14 when the toy vehicle 10 is operated on water. In this regard it is noted that FIG. 1 is a merely schematic drawing and therefore it does not necessarily show the exact location of the motors 18 and 20 and of other hereinafter described parts in the actual embodiments of the toy vehicle 10. In the herein described specific embodiment, the motors 18 and 20 are mounted within the interior of the hull 16 and comprise direct current electric motors which receive their supply of electric power from a battery 22. The battery 22 is also mounted within the interior of the hull 16, and electrical connection of the battery 22 with the motors 18 and 20 is schematically illustrated on FIG. 1 with dotted lines.

Each motor 18 and 20 has a rotating output shaft (not shown) which is provided with a pinion gear. The pinion gears are directly mounted to the output shafts (not shown) of the electric motors 18 and 20, and respectively bear the reference nummerals 24 and 26.

A first and a second axle 28 and 30 are rotatably mounted to the hull 16 in dispositions which form a small acute angle with the general longitudinal axis of the hull 16, as is shown on FIG. 1. The first axle 28 is mounted to one side of the general longitudinal axis and the second axis 30 is mounted to the other side of the same. In other words, the axles 28 and 30 are offset to the sides of the hull 16 from the general longitudinal axis of the hull 16, and are slightly convergent relative to one another so that their imaginary extensions meet outside of the hull 16, behind the vehicle 10.

Each axle 28 and 30 is provided with a gear at one end thereof which is proximate to the respective motor 18 or 20, and the gears respectively engage the pinion gears 24 and 26. The gears bear the reference numerals 32 and 34 on the drawing figures.

Figure 2:
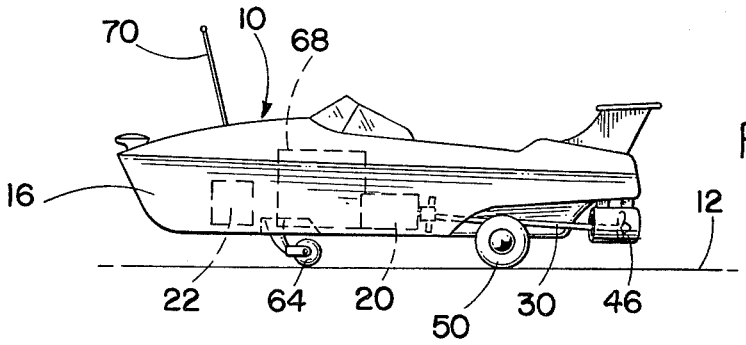
FIG. 2 is a schematic side view of the specific embodiment of the amphibious toy vehicle of the present invention, the view showing operation of the vehicle on a solid support surface.
Figure 3:
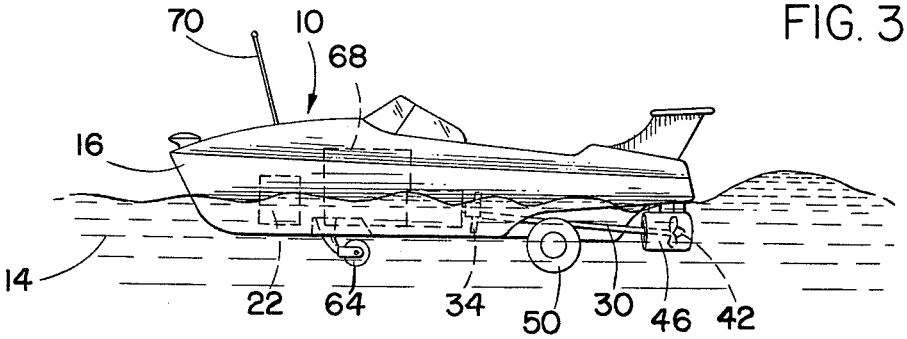
FIG. 3 is a schematic side view of the specific embodiment of the amphibious toy vehicle of the present invention, the view showing operation of the vehicle on water.

Referring now to FIGS. 2 and 3 it is shown that the axles 28 and 30 protrude from the interior of the hull 16 through a watertight seal (not shown), and at respective rear ends 36 and 38 thereof are directly connected to screw propellers 40 and 42.

In the specific embodiment described here, each screw propeller 40 and 42 is mounted within a shield or enclosure 44 and 46 is designed to prevent accidental injury to a player from the rotating propellers 40 and 42.

The screw propellers 40 and 42 are positioned relative to the toy vehicle 10 in such a manner that when the toy vehicle 10 is floated on water, both propellers 40 and 42 are at least substantially submerged in water, as is shown in FIG 3. Therefore rotation of the propellers 40 and 42 results in a thrust which moves the vehicle 10 on the water 14 surface in the direction indicated by an arrow on FIG. 3. Because the first and second axles 28 and 30 are slightly convergent relative to one another the corresponding thrust force vectors of the two propellers 40 and 42 are also convergent to one another. These thrust force vectors are schematically indicated by dotted arrows on FIG. 1. As is readily apparent to those familiar with basic hydrodynamics principles, the mild convergence of the thrust force vectors helps to maintain directional stability in a straight, forward motion of the toy vehicle 10 on water 14. In alternative embodiments of the toy vehicle 10 of the present invention, the first and second screw propellers 40 and 42, instead of being directly mounted to the respective first and second axles 28 and 30, may be operatively connected thereto through suitable gear mechanism (not shown).

Still referring principally to the schematic view of FIG. 1, a first and a second drive wheel 48 and 50, are disclosed. The first and second drive wheels 48 and 50 are mounted below the hull 16 on either side of the general longitudinal axis of the hull 16. The wheels 48 and 50 come into contact with the solid support surface 12 when it is desired to operate the toy vehicle 10 as a land going vehicle, as is shown on FIG. 2. Each drive wheel 48 and 50 is fixedly mounted upon an individual wheel axle 52 and 54 which is rotatable relative to the hull 16, and which is at a substantially right angle relative to the general longitudinal axis of the hull 16. Each drive axle 52 and 54 bears a crown gear 56 and 58 which meshes with a respective pinion gear 60 and 62 intermediately positioned on each axle 28 and 30. A freely swiveling castor wheel 64 is mounted to the hull 16 forward of the drive wheels 48 and 50. The castor wheel 64 is also in contact with the support surface 12 when the toy vehicle 10 is operated as a land going vehicle.

In alternate embodiments of the toy vehicle 10 of the present invention, the drive wheels may be modified to drive caterpillar treads rather than being in direct contact with the support surface.

It is readily apparent from the foregoing description and from an inspection of the drawing figures that when the first and the second motors 18 and 20 rotate at an even speed relative to one another the screw propellers 40 and 42 and the drive wheels 48 and 50 also rotate at an even speed relative to one another. Consequently the vehicle 10 moves in a substantially straight, forwardly direction whether it is in water or on the solid surface 12. In this regard, it is noted that the rotating wheels 48 and 50 do not significantly influence the motion of the vehicle 10 on water 14, and the rotating screw propellers 40 and 42 do not significantly influence the motion of the vehicle 10 on the solid support surface 12.

It is also readily apparent from the above description that when the speed of rotation of the first and second motors 18 and 20 is uneven relative to one another, the vehicle 10 turns toward the side of the slower rotating motor on the solid surface 12 and also in water. In the former case, the uneven speed of rotation of the drive wheels 48 and 50, and in the latter case of the uneven thrust of the screw propellers 40 and 42 causes the turns.

It is an important aspect of the present invention that control of the power output or speed of the motors 18 and 20, and therefore steering of the vehicle 10 may be exercised by an operator or player from a location which is remote from the toy vehicle 10. In order to accomplish this end, a remote control system is provided and operatively associated with the toy vehicle 10. More specifically, in the herein described specific embodiments of the toy vehicle 10, a radio signal transmitting device 66 is provided. This is schematically shown on FIG. 1. The signal transmitting device 66 is adapted to be hand held and easily manipulated by a child player, (not shown) e.g. the transmitting device 66 may include a miniature steering wheel (not shown) which is to be turned by the player in the same manner as if the player was driving the vehicle 10 either on land or water.

In response to the manipulation by the player, such as e.g. turning the steering wheel (not shown) the transmitting device transmits modulated radio signals. The miniature steering wheel in reality may control a potentiometer (not shown). The modulated radio signals conveying information necessary for the steering of the vehicle 10 are, in turn, received by a suitable signal receiving device schematically shown on FIG. 1 as 68.

The signal receiving device 68 is operatively connected with the battery 22 and with the two electric motors 18 and 20. In order to facilitate reception of the radio siganals the toy vehicle 10 may be provided with an antenna 70, as is shown on FIGS. 2 and 3.

In the signal receiving device 68 the command signals are demodulated. In response to the signals, power is provided from the battery 22 to the electric motors 18 and 20 in accordance with the command signals. Thus, if it is desired to move the toy vehicle 10 in a straight, forwardly direction the command signals indicate that even level of power is to be provided to the two electric motors 18 and 20. Conversely if the player (not shown) wishes the toy vehicle to turn, e.g. to the right, he may turn the miniature steering wheel (not shown) of the hand held signal transmitting device 66 to the right. This increases the power available to the motor and associated wheel and screw propeller on the left of the vehicle 10 relative to the power available to the motor on the right of the vehicle 10. As a result, the vehicle 10 turns to the right.

Since the present invention is not directed towards any specific type of remote control system including a specific signal transmitting and a specific signal receiving device, the description of these and of the associated control circuitry (not shown) is not deemed necessary here. The construction of a suitable remote control system is well within the present state of the electronic arts. Furthermore, it is noted that the signal transmitting and signal receiving devices as well as the associated control circuitry described in either U.S. Pat. No. 4,080.602, U.S. Pat. No. 3,372,393 or in West German patent application laid open to the public Ser. No. 28 16 416 may be readily adapted for the practice of the present invention. The specifications of U.S. Pat. Nos. 4,080,602 and 3,372,393 are therefore, expressly incorporated by reference.

In alternate embodiments of the present invention the signal transmitting device 66 may be connected by a flexible cable to the signal receiving device 68. In this case the dotted line connecting the signal transmitting and control means 66 with the signal receiving means 68 on FIG. 1 symbolizer the flexible cable. In this case, as is readily apparent to those skilled in the electric and electronic arts, the circuitry of the entire control system may be significantly simplified.

What has been described above is a remote controlled amphibious vehicle which can be steered both on a solid surface and on water by varying the power output of individual motors coupled to individual drive wheels and water propulsion means provided in the vehicle. Several modifications of the present invention may become readily apparent to those skilled in the art. Therefore the scope of the present invention should be interpreted solely from the following claims.

What is claimed is:

1. A steerable self-propelling toy vehicle capable of moving on a solid support surface and on water, the vehicle comprising:

a hull having sufficient buoyancy to keep the vehicle afloat on water, and having a general longitudinal axis;

a first variable speed motor and a second variable speed motor incorporated in the hull;

a first and second axle connected respectively to the first and second motor and extending at inclined angles to the longitudinal axis;

a power source operatively connected to the first and second motors;

a first and second wheel mounted to the hull for driving the vehicles on the solid support surface when the vehicle is operated as a land going vehicle, the first wheel being positioned offset to one side of the vehicle relative to the general longitudinal axis of the hull and being operatively connected to the first axle of the first motor to be driven thereby, the second wheel being positioned offset to the other side of the vehicle relative to the general longitudinal axis of the hull and being operatively connected to the second axle of the second motor to be driven thereby;

a first screw propeller and a second screw propeller mounted to the hull for contact with water when the vehicle is operated on water, the first screw propeller being positioned offset to one side of the vehicle relative to the general longitudinal axis of the hull and operatively connected to the first axle of the first motor to be driven thereby, the second screw propeller being positioned offset to the other side of the vehicle relative to the general longitudinal axis of the hull, and operatively connected to the second axle of the second motor to be driven thereby, the first and second screw propellers are positioned to provide respective thrust force vectors which converge and substantially cross one another outside of the hull and behind the vehicle, and control means operatively connected to the power source and the first and second motors for continuously and differentially varying, at the option of an operator, the levels of power supplied from the power source respectively to the first and second motors to vary the relative rotation of respectively the first and second wheels and the first and second screw propellers whereby the operator steers the vehicle both on the solid surface and on water by manipulating the control means to drive a predetermined wheel or screw propeller at a greater relative rotational speed to effectuate steering.

2. The invention of claim 1 wherein the control means includes a control box adapted to be hand held remote from the vehicle.

3. The invention of claim 1 wherein the control means comprise radio signal transmitting means adapted to be handheld and manipulated by the operator at a remote location from the vehicle, and signal receiving means incorporated in the vehicle and operatively associated with the power source and with the first and second motors, the signal transmitting means emitting command signals and the signal receiving means receiving the command signal and applying power to the first and second motors in substantial conformance to the command signals.

4. The invention of claim 1 wherein the first and second motors respectively drive a first and a second axle which directly drive the respective first and second screw propellers and which also drive the first and second wheels respectively through a first and a second gear mechanism.

5. The invention of claim 4 wherein the first and second gear mechanisms each comprise a first and a second pinion gear mounted on the respective first and second axles, and a first and a second crown gear connected with the respective first and second wheels and meshed with the respective first and second pinion gear.

6. The invention of claim 1 wherein the vehicle further comprises at least one castor wheel mounted to the hull for contacting the solid support surface when the vehicle is operated on the solid support surface.

7. The invention of claim 6 wherein the screw propellers are mounted in an enclosure provided substantially at a rear portion of the hull, the enclosure being elevated relative to the first and second wheels so as not to contact the solid support surface and to provide protection to an operator from the rotating screw propellers.

8. A radio controlled self-propelling steerable amphibious toy vehicle comprising:

a hull having sufficient buoyancy to float the vehicle on water;

a source of electric power incorporated in the hull;

a first and a second electric motor incorporated in the hull and driven by the source of electric power, each motor being adapted to provide a continuously variable output of power;

a first and second axle connected resectively to the first and second electric motor;

a first and a second drive wheel mounted to the hull for driving the vehicle on a solid support surface when the amphibious vehicle is operated as a land vehicle, the first and the second drive wheels being operatively connected to and driven by the respective first and second axles to propel the vehicle along the solid support surface;

a first propeller and a second propeller for driving the amphibious vehicle on the surface of water when the vehicl is operated as a water going vehicle, the first propeller and the second propeller being mounted to the hull and also being driven directly by the respective axles connected to the first and second electric motors; the first and second propellers are so aligned relative to the hull that thrust force vectors of the respective first and second propellers cross one another behind the vehicle when the vehicle is operated as a water going vehicle, a first and second shield member encompassing the respective propellers to prevent perpheral contact when the vehicle is being driven on the land;

radio signal transmitting means to transmit command signals at the option of a player to adjust the electric power respectively applied to the first and second electric motors, and radio signal receiving means incorporated in the vehicle and operatively connected to the source of electric power and the first and second electric motors for receiving and demodulating the command signals and for correspondingly applying a predetermined level of electric power to the respective first and second electric motors whereby the power output of the first and second drive wheels and of the first and second propulsion means is controlled by the player and whereby the amphibious vehicle may be steered on the solid support surface and on water by varying the respective level of electric power applied to the first and second electric motors.

9. The invention of claim 8 wherein the first electric motor and the second electric motor respectively each drive a first and a second axle, and wherein the first axle and the second axle are permanently connected to the respective first and second drive wheels and to the respective first and second propulsion means whereby the drive wheels and the propulsion means are operated simultaneously whenever the vehicle is operated.

10. The invention of claim 9 wherein the first and second axles respectively bear a first pinion gear and a second pinion gear, which respectively engage first and second crown gear, the first and second crown gears respectively driving the first and second wheels.

11. The invention of claim 8 further comprising a castor wheel mounted to the hull for coming into contact with the solid support surface when the vehicle is operated as a land vehicle, the castor wheel facilitating a steering of the vehicle by the first and second drive wheels on a support surface.

12. The invention of claim 8 wherein the signal transmitting means transmit pulse duration modulated command signals.

* * * * *